US006702937B2

(12) United States Patent
Johnson et al.

(10) Patent No.: US 6,702,937 B2
(45) Date of Patent: Mar. 9, 2004

(54) PROCESS FOR UPGRADING FISCHER-TROPSCH PRODUCTS USING DEWAXING AND HYDROFINISHING

(75) Inventors: David R. Johnson, Petaluma, CA (US); Christopher A. Simmons, El Cerrito, CA (US); Donald H. Mohr, Orinda, CA (US); Stephen J. Miller, San Francisco, CA (US); Stephen K. Lee, Oakland, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 10/068,927

(22) Filed: Feb. 8, 2002

(65) Prior Publication Data

US 2003/0150777 A1 Aug. 14, 2003

(51) Int. Cl.[7] ..... C10G 69/02; C10G 73/38

(52) U.S. Cl. ..... 208/97; 208/95; 208/27; 585/738; 585/739

(58) Field of Search ..... 208/95, 97, 27; 585/738, 739

(56) References Cited

U.S. PATENT DOCUMENTS

| | | | | |
|---|---|---|---|---|
| 3,226,339 A | * | 12/1965 | Frilette et al. | 502/74 |
| 3,852,207 A | | 12/1974 | Stangeland et al. | |
| 4,176,050 A | | 11/1979 | Chen et al. | |
| 4,181,598 A | | 1/1980 | Gillespie et al. | |
| 4,211,635 A | | 7/1980 | Chen | |
| 4,222,855 A | | 9/1980 | Pelrine et al. | |
| 4,229,282 A | | 10/1980 | Peters et al. | |
| 4,417,088 A | | 11/1983 | Miller | |
| 4,673,487 A | | 6/1987 | Miller | |
| 4,827,064 A | | 5/1989 | Wu | |
| 4,827,073 A | | 5/1989 | Wu | |
| 4,859,311 A | | 8/1989 | Miller | |
| 4,990,709 A | | 2/1991 | Wu | |
| 5,082,986 A | | 1/1992 | Miller | |
| 5,135,638 A | | 8/1992 | Miller | |
| 5,246,566 A | | 9/1993 | Miller | |
| 5,282,958 A | | 2/1994 | Santilli et al. | |
| 5,723,716 A | | 3/1998 | Brandes et al. | |
| 5,939,349 A | | 8/1999 | Kibby et al. | |
| 6,080,301 A | | 6/2000 | Berlowitz et al. | |
| 6,544,407 B1 | * | 4/2003 | Calemma et al. | 208/111.35 |

FOREIGN PATENT DOCUMENTS

| | | | | |
|---|---|---|---|---|
| EP | 323092 A2 | * | 7/1989 | C10G/45/62 |
| EP | 0609 079 B1 | | 7/1998 | |

* cited by examiner

*Primary Examiner*—Walter D. Griffin
(74) *Attorney, Agent, or Firm*—James W. Ambrosius

(57) ABSTRACT

A process for producing low pour point diesel and lubricating base oil products by bulk dewaxing a $C_5$ plus Fischer-Tropsch syncrude, hydrofinishing the dewaxed intermediate, and recovering 120 degrees C. plus products having improved properties.

17 Claims, 1 Drawing Sheet

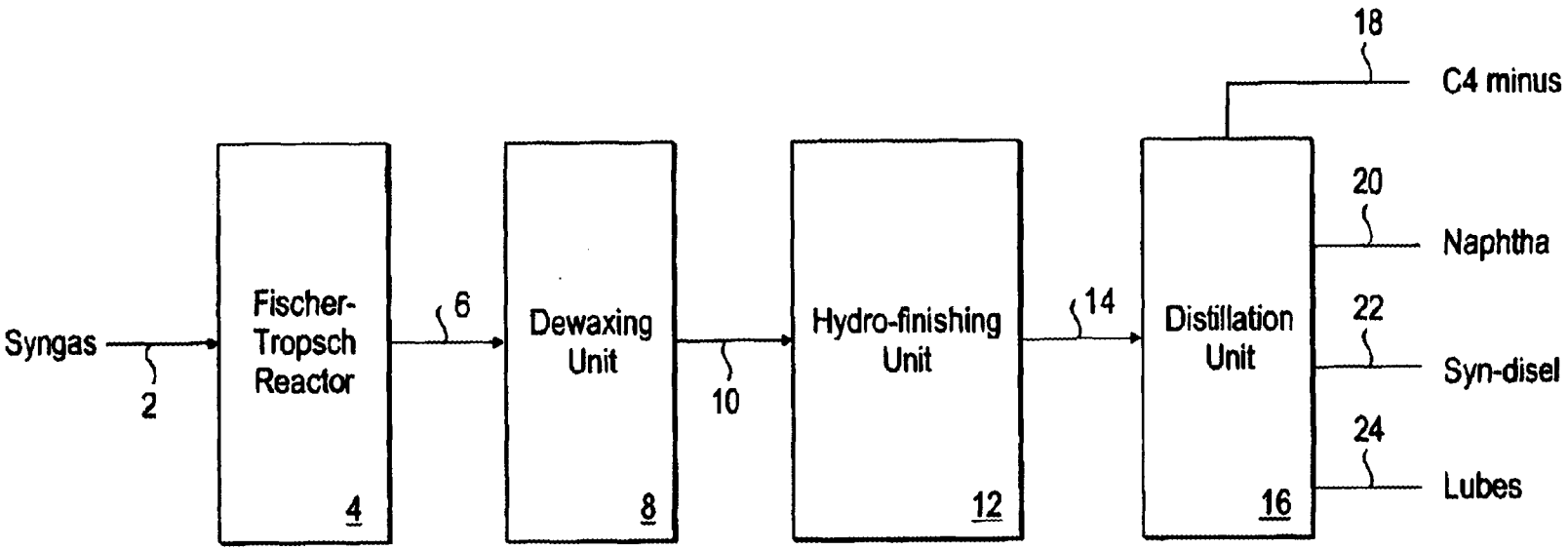
Syngas
2
Fischer-Tropsch Reactor
4
6
Dewaxing Unit
8
10
Hydro-finishing Unit
12
14
Distillation Unit
16
18
C4 minus
20
Naphtha
22
Syn-disel
24
Lubes

PROCESS FOR UPGRADING FISCHER-TROPSCH PRODUCTS USING DEWAXING AND HYDROFINISHING

FIELD OF THE INVENTION

The invention relates to a process for upgrading the hydrocarbons having an initial boiling point above about 120 degrees C. recovered from a Fischer-Tropsch plant by bulk dewaxing a $C_5$ plus hydrocarbon Fischer-Tropsch syncrude followed by hydrofinishing and recovering diesel and lubricating base oil products having improved properties.

BACKGROUND OF THE INVENTION

The market for lubricating base oils of high paraffinicity is continuing to grow due to the high viscosity index, oxidation stability, and low volatility relative to viscosity of these oils. The products produced from the Fischer-Tropsch process (syncrude) contain a high proportion of wax which make them ideal candidates for processing into lubricating base stocks. Accordingly, the hydrocarbon products recovered from the Fischer-Tropsch process have been proposed as feedstocks for preparing high quality lubricating base oils. See, for example, U.S. Pat. No. 6,080,301 which describes a premium lubricating base oil having a high non-cyclic isoparaffin content prepared from Fischer-Tropsch waxes by hydroisomerization dewaxing and solvent dewaxing.

High quality diesel products also may be prepared from the syncrude recovered from the Fischer-Tropsch process. Fischer-Tropsch derived diesel typically has a very low sulfur content and an excellent cetane number. These qualities make Fischer-Tropsch derived diesel an excellent blending stock for upgrading lower quality petroleum-derived diesel.

In general, for the purposes of this disclosure, diesel is considered as having a upper boiling point of about 700 degrees F. (370 degrees C.) and an initial boiling point of about 300 degrees F. (about 150 degrees C.). Lubricating base oils typically will have an initial boiling point above about 600 degrees F. (about 315 degrees C.). The syncrude fractions boiling in the range of diesel and lubricating base oils as they are initially recovered from the Fischer-Tropsch plant will usually contain a high proportion of waxy normal paraffins and unsaturated hydrocarbons, and therefore, these fractions require upgrading to meet commercial specifications for the finished products prior to their use either alone or as blending stock. During upgrading the various fractions are separated according to their respective boiling ranges. In the case of those fractions boiling in the ranges of lubricating base oils and diesel, upgrading steps generally are intended to lower the pour point to an acceptable temperature and to improve the oxidation and UV stability of the products. In order to improve the properties of these fractions, they are separated from the syncrude and separately dewaxed and hydrofinished. Applicants have discovered that contrary to conventional teaching, it is advantageous to bulk dewax and hydrofinish the entire $C_5$ plus syncrude fraction prior to separation of the various fractions.

Fischer-Tropsch wax refers to a high boiling fraction from the Fischer-Tropsch derived syncrude and is most often a solid at room temperature. For the purpose of this disclosure "Fischer-Tropsch wax" is contained in the higher boiling portion of the Fischer-Tropsch syncrude. Fischer-Tropsch wax contains at least 10 percent by weight of $C_{20}$ and higher hydrocarbonaceous compounds, preferably at least 40 percent by weight of $C_{20}$ and higher hydrocarbonaceous compounds, and most preferably at least 70 percent by weight of $C_{20}$ and higher hydrocarbonaceous compounds. Fischer-Tropsch wax is important for the present invention because this fraction will contain the heavier hydrocarbons which when sent to the catalytic dewaxing operation will be converted to high quality lubricating base oil and diesel.

$C_5$ plus syncrude refers to those fractions of the product from a Fischer-Tropsch plant which are normally a liquid or solid at ambient temperature. Usually hydrocarbons boiling above ambient temperature will include those hydrocarbons containing 5 or more carbon atoms in the molecule. However, one skilled in the art will recognize that other factors besides carbon number will affect the boiling ranges of the Fischer-Tropsch syncrude fractions, such as, for example, the presence of unsaturated bonds, branching, and heteroatoms in the molecule. Therefore, some hydrocarbons may be present in this fraction which contain less than 5 carbon atoms. Products recovered from the Fischer-Tropsch synthesis which are normally in the gaseous phase at ambient temperature are referred to as $C_4$ minus product in this disclosure. LPG which is primarily a mixture of propane and butane is an example of a $C_4$ minus product.

Fractions boiling in the range of diesel may also be referred to as $C_{10}$ to $C_{19}$ hydrocarbons. Likewise, Fischer-Tropsch wax preferably is comprised predominantly of "$C_{20}$ plus product" which refers to a product comprising primarily hydrocarbons having more than 20 carbon atoms in the backbone of the molecule and having an initial boiling point at the upper end of the boiling range for diesel. It should be noted that the upper end of the boiling range for diesel and the lower end of the boiling range for Fischer-Tropsch wax have considerable overlap. The term "naphtha" when used in this disclosure refers to a liquid product having between about $C_5$ to about $C_9$ carbon atoms in the backbone and will have a boiling range generally below that of diesel but wherein the upper end of the boiling range will overlap that of the initial boiling point of diesel. $C_{10}$ plus hydrocarbons generally boil above the range of naphtha, i.e., the fractions boiling within the range of diesel and lubricating base oils or above about 150 degrees C. The precise cut-point selected for each of the products in carrying out the distillation operation will be determined by the product specifications and yields desired.

The dewaxing and hydrofinishing of $C_{20}$ plus hydrocarbons, including Fischer-Tropsch-derived syncrude is discussed in U.S. Pat. No. 5,135,638. The isomerization of lighter feeds boiling in the range of naphtha and diesel by contacting the feed with a catalyst containing a silicoaluminophosphate molecular sieve (SAPO) is discussed in U.S. Pat. No. 4,859,311.

As used in this disclosure the words "comprises" or "comprising" is intended as an open-ended transition meaning the inclusion of the named elements, but not necessarily excluding other unnamed elements. The phrase "consists essentially of " or "consisting essentially of" is intended to mean the exclusion of other elements of any essential significance to the composition. The phrases "consisting of" or "consists of" are intended as a transition meaning the exclusion of all but the recited elements with the exception of only minor traces of impurities.

SUMMARY OF THE INVENTION

Broadly, the present invention is directed to a process for producing low pour point hydrocarbon products having an initial boiling point above about 150 degrees C. from a Fischer-Tropsch plant which comprises (a) recovering a feedstock comprising $C_5$ plus syncrude from a Fischer-Tropsch plant; (b) dewaxing the $C_5$ plus syncrude feedstock in a catalytic dewaxing zone by contacting the $C_5$ plus syncrude feedstock with a dewaxing catalyst under dewaxing conditions, whereby a $C_5$ plus intermediate is produced having a lowered pour point relative to the $C_5$ plus syncrude feedstock; (c) hydrofinishing the $C_5$ plus intermediate in a hydrofinishing zone under hydrofinishing conditions, whereby a UV stabilized $C_5$ plus product is produced; and (d) separately collecting from the UV stabilized $C_5$ plus product a low pour point product having an initial boiling point above about 150 degrees C. The low pour point product of step (d) will generally consist of diesel and lubricating base oil products, although depending on how the operation is run the proportional yields of the products may vary over a considerable range.

In one embodiment of the invention, the preferred dewaxing catalyst is a hydroisomerization catalyst, such as, for example, a catalyst comprising a silicoaluminophosphate molecular sieve, commonly referred to as a SAPO, in combination with a hydrogenation component comprising an active metal. The SAPO is preferably an intermediate pore SAPO, such as, for example, SAPO-11, SAPO-31, and SAPO-41, with SAPO-11 being especially preferred. Other aluminophosphates besides SAPO's can be used (broad category of "non-zeolitic molecular sieves") and are taught in U.S. Pat. No. 5,135,638, col. 10, lines 24–31. A more complete description is in U.S. Pat. No. 5,883,837, col. 8, lines 5–17. Accordingly, this embodiment of the invention may be described as a process for producing low pour point syncrude products having an initial boiling point above about 150 degrees C. from a Fischer-Tropsch plant which comprises (a) recovering a feedstock comprising $C_5$ plus syncrude from a Fischer-Tropsch plant; (b) dewaxing the $C_5$ plus syncrude feedstock in a hydroisomerization zone by contacting the $C_5$ plus syncrude feedstock with a hydroisomerization catalyst under hydroisomerization conditions, whereby an isomerized $C_5$ plus intermediate is produced having a lowered pour point relative to the $C_5$ plus syncrude feedstock; (c) hydrofinishing the isomerized $C_5$ plus intermediate in a hydrofinishing zone under hydrofinishing conditions, whereby a UV stabilized $C_5$ plus product is produced; and (d) separately collecting from the UV stabilized hydrocarbon product a low pour point diesel product and a lubricating base oil product. Hydroisomerization catalysts comprising SAPO-11 in association with a hydrogenation component are particularly preferred. The hydrogenation component usually comprises an active metal, such as molybdenum, nickel, vanadium, cobalt, tungsten, zinc, platinum, and palladium. The metals platinum and palladium are especially preferred as the active metals. Those SAPOs in which the metals have been added by means of non-aqueous addition as taught in U.S. Pat. No. 5,939,349 are especially preferred.

Ultra high VI base oil products, i.e., products having a VI of greater than 140, can be obtained by using a dewaxing catalyst comprising a intermediate pore zeolite, usually in association with an active metal having hydrogenation activity. Suitable intermediate pore size zeolites include SSZ-32, ZSM-22, ZSM-23, ZSM-35, and ZSM-48. The zeolites SSZ-32, ZSM-22, and ZSM-23 are particularly preferred. The active metal component is as already described above. This embodiment of the present invention may be described as a process for producing an ultra high VI, low pour point lubricating base oil product from a Fischer-Tropsch plant which comprises (a) recovering a feedstock comprising $C_5$ plus syncrude from a Fischer-Tropsch plant; (b) dewaxing the $C_5$ plus syncrude feedstock in a catalytic hydrodewaxing zone by contacting the $C_5$ plus hydrocarbon feedstock with hydroisomerization dewaxing catalyst comprising an intermediate pore size zeolite and at least one metal having hydrogenation activity, said dewaxing being carried out under hydrodewaxing conditions selected to produce an $C_5$ plus intermediate having a lowered pour point relative to the $C_5$ plus syncrude feedstock; (c) hydrofinishing the $C_5$ plus intermediate in a hydrofinishing zone under hydrofinishing conditions, whereby a UV stabilized $C_5$ plus product is produced; and (d) separately collecting from the UV stabilized $C_5$ plus product an ultra high VI, low pour point lubricating base oil product. The term "intermediate pore size" when referring to either a zeolite or a SAPO in this disclosure means an inorganic molecular sieve having an effective pore aperture in the range of from about 5.3 to about 6.5 Angstrom when the porous inorganic oxide is in the calcined form. The most preferred zeolites for producing ultra high VI products are somewhat more restricted having an effective pore aperture of between about 5.0 to about 5.5 Angstrom.

In conventional processes for upgrading Fischer-Tropsch product into diesel and lubricating base oils, the various fractions usually are separated prior to upgrading. During dewaxing of that Fisher-Tropsch fraction boiling above about 315 degrees C. some wax cracking will occur which will yield lower molecular products such as diesel, naphtha, and $C_5$ minus hydrocarbons. When one of the preferred SAPO catalysts having high diesel selectivity, such as SAPO-11, is used to dewax the fraction boiling in the lubricating base oil range, diesel is preferentially produced as opposed to less valuable products such as naphtha and $C_5$ minus hydrocarbons. In a conventional operation, a second separation will generally be necessary following the dewaxing operation, since considerable additional high value diesel is produced. In the present invention only a single separation step is necessary to collect all of the diesel which results in a significant cost saving. In addition, with the present invention, the diesel fraction recovered from the dewaxing operation will have an especially low pour point, preferably below about −20 degrees C. and more preferably below about −30 degrees C. The low pour point of the diesel allows the end point to be extended which also increases the yield of diesel in the overall product slate.

BRIEF DESCRIPTION OF THE DRAWING

The FIGURE is a schematic diagram of one embodiment of the invention.

DETAILED DESCRIPTION OF THE INVENTION

The present invention will be more clearly illustrated by reference to the figure. Synthesis gas or syngas comprised primarily of carbon monoxide and hydrogen is sent to the Fischer-Tropsch reactor 4 via inlet 2. The Fischer-Tropsch syncrude comprised primarily of $C_5$ plus hydrocarbons is carried by line 6 to the dewaxing unit 8 where the pour point of the syncrude, especially of those fractions of the syncrude boiling in the range of diesel and lubricating base oils is lowered. The $C_5$ plus intermediate that is collected from the dewaxing unit is carried by line 10 to the hydrofinishing unit 12 where any remaining unsaturated carbon-to-carbon double bonds are saturated and the UV stability of the hydrocarbons is improved. The UV stabilized $C_5$ plus product is collected by line 14 and sent to the distillation column 16 where the various fractions are separated. In the figure the products shown as being separately collected are $C_4$ minus product 18, naphtha 20, diesel 22, and lubricating base oil 24, respectively.

Fischer-Tropsch Synthesis

In the Fischer-Tropsch synthesis process, liquid and gaseous hydrocarbons are formed by contacting a synthesis gas (syngas) comprising a mixture of hydrogen and carbon monoxide with a Fischer-Tropsch catalyst under suitable temperature and pressure reactive conditions. The Fischer-Tropsch reaction is typically conducted at temperatures of from about 300 F. to about 700 degrees F. (about 150 degrees C. to about 370 degrees C.) preferably from about 400 degrees F. to about 550 degrees F. (204 degrees C. to 228 degrees C.); pressures of from about 10 to about 600 psia, (0.7 bar to 41 bars) preferably 30 psia to 300 psia, (2 bars to 21 bars) and catalyst space velocities of from about 100 cc/g/hr to about 10,000 cc/g/hr., preferably 300 to 3,000 cc/g/hr.

The products may range from $C_1$ to $C_{200}$ plus hydrocarbons with a majority in the $C_5$ to $C_{100}$ plus range. The reaction can be conducted in a variety of reactor types, for example, fixed bed reactors containing one or more catalyst beds, slurry reactors, fluidized bed reactors, or a combination of different type reactors. Such reaction processes and reactors are well known and documented in the literature. Slurry Fischer-Tropsch processes, which is a preferred process in the practice of the present invention, utilize superior heat (and mass) transfer characteristics for the strongly exothermic synthesis reaction and are able to produce relatively high molecular weight, paraffinic hydrocarbons when using a cobalt catalyst. In a slurry process, a syngas comprising a mixture of hydrogen and carbon monoxide is bubbled up as a third phase through a slurry in a reactor which comprises a particulate Fischer-Tropsch type hydrocarbon synthesis catalyst dispersed and suspended in a slurry liquid comprising hydrocarbon products of the synthesis reaction which are liquid at the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP0609079, which is completely incorporated herein by reference for all purposes.

Suitable Fischer-Tropsch catalysts comprise one or more Group VIII catalytic metals such as Fe, Ni, Co, Ru and Re, with cobalt being preferred. Additionally, a suitable catalyst may contain a promoter. Thus, a preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight percent of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Catalytic Dewaxing

Although not shown in the figure, it may be desirable to include a pretreatment step for the syncrude prior to its introduction into the dewaxing unit, since raw syncrude typically contains a number of contaminants which act as catalyst poisons, most notably nitrogen and oxygen compounds. Both the nitrogen and oxygen compounds may be removed by hydrotreating. Preferably the nitrogen in the feed stock to the dewaxing reactor should be below 50 ppm and more preferably below 10 ppm. Alternatively, the alcohols may be dehydrated to remove water prior to dewaxing. Other methods for removing contaminants include adsorption and extraction.

Catalytic dewaxing consists of three main classes, conventional hydrodewaxing, complete hydroisomerization dewaxing, and partial hydroisomerization dewaxing. All three classes involve passing a mixture of a waxy hydrocarbon stream and hydrogen over a catalyst that contains an acidic component to convert the normal and slightly branched iso-paraffins in the feed to other non-waxy species, such as lubricating oil base stocks with acceptable pour points. Typical conditions for all classes involve temperatures from about 400 degrees F. to about 800 degrees F. (200 degrees C. to 425 degrees C.), pressures from about 200 psig to 3000 psig, and space velocities from about 0.2 to 5 hr-1. The method selected for dewaxing a feed typically depends on the product quality, and the wax content of the feed, with conventional hydrodewaxing often preferred for low wax content feeds. The method for dewaxing can be effected by the choice of the catalyst. The general subject is reviewed by Avilino Sequeira, in *Lubricant Base Stock and Wax Processing*, Marcel Dekker, Inc. pages 194–223. The determination between conventional hydrodewaxing, complete hydroisomerization dewaxing, and partial hydroisomerization dewaxing can be made by using the n-hexadecane isomerization test as described in U.S. Pat. No. 5,282,958. When measured at 96 percent, n-hexadecane conversion using conventional hydrodewaxing catalysts will exhibit a selectivity to isomerized hexadecanes of less than 10 percent, partial hydroisomerization dewaxing catalysts will exhibit a selectivity to isomerized hexadecanes of greater than 10 percent to less than 40 percent, and complete hydroisomerization dewaxing catalysts will exhibit a selectivity to isomerized hexadecanes of greater than or equal to 40 percent, preferably greater than 60 percent, and most preferably greater than 80 percent.

In conventional hydrodewaxing, the pour point is lowered by selectively cracking the wax molecules mostly to smaller paraffins using a conventional hydrodewaxing catalyst, such as, for example ZSM-5. Metals may be added to the catalyst, primarily to reduce fouling. In the present invention conventional hydrodewaxing may be used to increase the yield of lower molecular weight products in the final product slate by cracking the Fischer-Tropsch wax molecules.

Complete hydroisomerization dewaxing typically achieves high conversion levels of wax by isomerization to non-waxy iso-paraffins while at the same time minimizing the conversion by cracking. Since wax conversion can be complete, or at least very high, this process typically does not need to be combined with additional dewaxing processes to produce a lubricating oil base stock with an acceptable pour point. Complete hydroisomerization dewaxing uses a dual-functional catalyst consisting of an acidic component and an active metal component having hydrogenation activity. Both components are required to conduct the isomerization reaction. The acidic component of the catalysts used in complete hydroisomerization preferably include an intermediate pore SAPO, such as SAPO-11, SAPO-31, and SAPO-41, with SAPO-11 being particularly preferred. Intermediate pore zeolites, such as ZSM-22, ZSM-23, SSZ-32, ZSM-35, and ZSM-48, also may be used in carrying out complete hydroisomerization dewaxing. Typical active metals include molybdenum, nickel, vanadium, cobalt, tungsten, zinc, platinum, and palladium. The metals platinum and palladium are especially preferred as the active metals, with platinum most commonly used.

In partial hydroisomerization dewaxing a portion of the wax is isomerized to iso-paraffins using catalysts that can isomerize paraffins selectively, but only if the conversion of wax is kept to relatively low values (typically below 50 percent). At higher conversions, wax conversion by cracking becomes significant, and yield losses of lubricating base stock becomes uneconomical. Like complete hydroisomerization dewaxing, the catalysts used in partial hydroisomerization dewaxing include both an acidic component and a hydrogenation component. The acidic catalyst components useful for partial hydroisomerization dewaxing include amorphous silica aluminas, fluorided alumina, and 12-ring zeolites (such as Beta, Y zeolite, L zeolite). The hydrogenation component of the catalyst is the same as already discussed with complete hydroisomerization dewaxing. Because the wax conversion is incomplete, partial hydroisomerization dewaxing must be supplemented with an additional dewaxing technique, typically solvent dewaxing, complete hydroisomerization dewaxing, or conventional hydrodewaxing in order to produce a lubricating base stock with an acceptable pour point (below about +10 degrees F. or −12 degrees C.).

The present invention may also be used to prepare ultra-high VI lubricating base oils. Catalysts containing SAPO's, such as SAPO-11, have been used to produce ultra-high VI lubricating base oils. However, an intermediate pore zeolite with one-dimensional pores, such as, for example, SSZ-32, ZSM-23, and ZSM-22 also may be used in carrying out the present invention if a lubricating base oil product having ultra high VI is desired. The term one-dimensional pores, also referred to as 1-D pores, is fully explained in U.S. Pat. No. 5,135,638, column 6, at lines 31–41. Briefly, the term refers to a zeolite in which the intracrystalline channels are parallel and are not interconnected. The production of ultra high VI lubricating base oil in this embodiment is particularly surprising because with conventional petroleum-derived feeds, catalysts containing SAPOs will usually produce a higher VI product than those catalysts containing a zeolite. Preferably the intermediate pore zeolite is used in association with an active metal having hydrogenation activity.

In preparing those catalysts containing a non-zeolitic molecular sieve and having an hydrogenation component for use in the present invention, it is usually preferred that the metal be deposited on the catalyst using a non-aqueous method. Catalysts, particularly catalysts containing SAPO's, on which the metal has been deposited using a non-aqueous method have shown greater selectivity and activity than those catalysts which have used an aqueous method to deposit the active metal. The non-aqueous deposition of active metals on non-zeolitic molecular sieves is taught in U.S. Pat. No. 5,939,349. In general, the process involves dissolving a compound of the active metal in a non-aqueous, non-reactive solvent and depositing it on the molecular sieve by ion exchange or impregnation.

Hydrofinishing

Hydrofinishing operations are intended to improve the UV stability and color of the products. It is believed this is accomplished by saturating the double bonds present in the hydrocarbon molecule, including those found in aromatics, especially polycyclic aromatics. In the process of the present invention, the $C_5$ plus intermediate recovered from the dewaxing operation is sent to a hydrofinisher. A general description of the hydrofinishing process may be found in U.S. Pat. Nos. 3,852,207 and 4,673,487. As used in this disclosure the term UV stability refers to the stability of the lubricating base oil or other products when exposed to ultraviolet light and oxygen. Instability is indicated when a visible precipitate forms or darker color develops upon exposure to ultraviolet light and air which results in a cloudiness or floc in the product. Lubricating base oils and diesel products prepared by the process of the present invention will require UV stabilization before they are suitable for use in the manufacture of commercial lubricating oils and marketable diesel.

Typically, the total pressure in the hydrofinishing zone will be between about 200 psig and about 3000 psig, with pressures in the range of about 500 psig and about 2000 psig being preferred. Temperature ranges in the hydrofinishing zone are usually in the range of from about 300 degrees F. (150 degrees C.) to about 700 degrees F. (370 degrees C.), with temperatures of from about 400 degrees F. (205 degrees C.) to about 500 degrees F. (260 degrees C.) being preferred. The LHSV is usually within the range of from about 0.2 to about 2.0, preferably 0.2 to 1.5 and most preferably from about 0.7 to 1.0. Hydrogen is usually supplied to the hydrofinishing zone at a rate of from about 1000 to about 10,000 SCF per barrel of feed. Typically the hydrogen is fed at a rate of about 3000 SCF per barrel of feed. The hydrofinishing step may be integrated into the same gas system as the dewaxing step.

Suitable hydrofinishing catalysts typically contain a Group VIII metal component together with an oxide support. Metals or compounds of the following metals are useful in hydrofinishing catalysts include nickel, ruthenium, rhodium, iridium, palladium, platinum, and osmium. Preferably the metal or metals will be platinum, palladium or mixtures of platinum and palladium. The refractory oxide support usually consists of alumina, silica, silica-alumina, silica-alumina-zirconia, and the like. The catalyst may optionally contain a zeolite component. Typical hydrofinishing catalysts are disclosed in U.S. Pat. Nos. 3,852,207; 4,157,294; and 4,673,487.

In carrying out the invention, the cut-point between those Fischer-Tropsch fractions boiling in the range of diesel and lubricating base oil may be adjusted to either increase the yield of diesel or the yield of lubricating base oil. For example by extending the cut-point for diesel, it is possible to not only maximize the yield of diesel but still also produce a diesel product having a very low cloud point and pour point. At the same time, the volatility of the lubricating base oil cut is minimized which is major commercial selling point for lubricants.

When a SAPO, such as SAPO-11, is used as the hydroisomerization catalyst in the dewaxing operation, diesel is the primary product of the wax-cracking. Consequently, the actual yield for the less valuable naphtha and $C_4$ minus gas is minimized. The cut-point between the diesel product and the lubricating base oil product during fractionation may also be adjusted to decrease or increase the amount of diesel present in the final product slate. For example, the cut-point selected could be as low as 600 degrees F. (515 degrees C.). This would increase the amount of lubricating base oil recovered at the expense of diesel. Likewise, the cut-point could be selected as high as 700 degrees F. (370 degrees C.) or more. This would increase the amount of diesel recovered at the expense of the yield of lubricating base oil. However, in this later case the diesel recovered will have an especially low pour point and the lubricating base oil will very low volatility.

Finally as already noted, the present process of the present invention requires only a single fractionation operation instead of the two fractionation steps which would be necessary using a conventional processing scheme. Accordingly, the present invention results in a significant cost savings over conventional operations.

The following example is intended to further illustrate a specific embodiment of the invention without being interpreted as a limitation thereon.

EXAMPLE

A Fischer-Tropsch derived feedstock having the specifications shown in Table 1 was dewaxed using a hydrocracking catalyst and a hydroisomerization catalyst.

TABLE 1

| | |
|---|---|
| API Gravity | 49.0 |
| Nitrogen, ppm | 17 |
| Sulfur, ppm | 11 |
| Oxygen, wt % | 1.12 |
| Simulated Distillation, TBP (° F.) | |
| 1/5 wt % | 152/236 |
| 10/30 | 287/422 |
| 50 | 564 |
| 70/90 | 718/965 |
| 95/99 | 1062/1275 |

A commercially available nickel-Tungsten silica/alumina diesel hydrocracking catalyst was compared to a hydroisomerization catalyst containing 25 weight percent SAPO-11 on alumina with platinum present as the hydrogenation component. The feed was dewaxed at a total pressure of 1000 psig, a liquid hourly space velocity of 1.0, and a once through gas rate of 10,000 SCF $H_2$/bbl. The products recovered from the dewaxing operation were not hydrofinished and had the properties shown in Table 2.

TABLE 2

| | Commercial Catalyst | Pt/SAPO-11 |
|---|---|---|
| Catalyst Temp, F. | 672 | 736 |
| Yields, wt % | | |
| C4- | 1.0 | 1.6 |
| Naphtha (C5-300° F.) | 13.7 | 17.5 |
| Diesel (300–700° F.) | 69.2 | 64.0 |
| Base Oil (700° F. +) | 15.2 | 16.0 |
| Diesel Properties | | |
| Cloud Pt, ° C. | −9 | −35 |
| Vis@40° C., cSt | 2.1 | 2.1 |
| Base Oil Properties | | |
| Pour Pt,° C. | +13 | −12 |
| Vis@100° C., cSt | 3.8 | 4.4 |
| VI | 133 | 158 |

Table 2 illustrates that the Fischer-Tropsch product may be bulk dewaxed and successfully produce satisfactory yields of diesel and lubricating base oil having excellent properties. The diesel recovered using the Pt/SAPO catalyst had a significantly lower cloud point than the diesel recovered using the conventional catalyst. When the lubricating base oils derived from the dewaxing operations are compared, it should be noted that the product derived using the Pt/SAPO catalyst had a significantly lower pour point and higher viscosity at 100 degrees C. In addition, the lubricating base oil product had a VI of 158 which is well in excess of that required to qualify as an ultra-high VI product.

What is claimed is:

1. A process for producing low pour point syncrude products having an initial boiling point above about 150 degrees C. from a Fischer-Tropsch plant which comprises:

(a) recovering a $C_5$ plus syncrude feedstock from a Fischer-Tropsch plant comprising a mixture of hydrocarbons boiling in the range of naphtha, diesel and lubricating base oils;

(b) bulk dewaxing the entire $C_5$ plus hydrocarbon feedstock in a hydroisomerization zone by contacting the $C_5$ plus syncrude feedstock with a hydroisomerization catalyst under hydroisomerization conditions, whereby an isomerized $C_5$ plus intermediate is produced having a lowered pour point relative to the $C_5$ plus syncrude feedstock;

(c) hydrofinishing the isomerized $C_5$ plus intermediate in a hydrofinishing zone under hydrofinishing conditions, whereby a UV stabilized $C_5$ plus product is produced; and (d) separately collecting from the UV stabilized $C_5$ plus product a low pour point diesel product and a lubricating base oil product.

2. The process of claim 1 wherein the hydroisomerization catalyst comprises an intermediate pore size SAPO and at least one hydrogenation component comprising an active metal having hydrogenation activity.

3. The process of claim 2 wherein the hydroisomerization catalyst comprises at least one SAPO selected from the group consists of SAPO-11, SAPO-31 and SAPO-41.

4. The process of claim 3 wherein the hydroisomerization catalyst comprises SAPO-11.

5. The process of claim 2 wherein at least the one of the active metal is selected from the group consisting of platinum and palladium.

6. The process of claim 5 wherein at least one of the active metal is platinum.

7. The process of claim 2 wherein the active metal is added to the hydroisomerization catalyst by non-aqueous addition.

8. The process of claim 1 wherein the hydrofinishing consisting of step (c) comprise a pressure of between about 200 psig to about 3000 psig.

9. The process of claim 8 wherein the hydrofinishing conditions comprise a pressure of between about 500 psig and about 2000 psig.

10. The process of claim 2 wherein the cut-point for the separation of the low pour point diesel product from the lubricating base oil product is pre-selected to maximize the yield of the low pour point diesel product.

11. A process for producing ultra high VI, low pour point lubricating base oil product from a Fischer-Tropsch plant which comprises:

(a) recovering a $C_5$ plus syncrude feedstock from a Fischer-Tropsch plant comprising a mixture of hydrocarbons boiling in the range of naphtha, a diesel and lubricating base oils;

(b) bulk dewaxing the entire $C_5$ plus syncrude feedstock in a catalytic hydrodewaxing zone by contacting the $C_5$ plus hydrocarbon feedstock with hydroisomerization dewaxing catalyst comprising an intermediate pore size zeolite and at least one metal having hydrogenation activity, said dewaxing being carried out under hydrodewaxing conditions selected to produce an $C_5$ plus intermediate having a lowered pour point relative to the $C_5$ plus syncrude feedstock;

(c) hydrofinishing the $C_5$ plus intermediate in a hydrofinishing zone under hydrofinishing conditions, whereby a UV stabilized $C_5$ plus product is produced; and (d) separately collecting from the UV stabilized $C_5$ plus product an ultra high VI, low pour point lubricating base oil product.

12. The process of claim 11 wherein the intermediate pore size zeolite is also characterized by having one-dimensional pore.

13. The process of claim 11 wherein the intermediate pore size zeolite having one dimensional pores comprises at least one zeolite selected from the group consisting of SSZ-32, ZSM-22 and ZSM-23.

14. The process of claim 11 wherein at least one of the active metal is selected from the group consisting of platinum and palladium.

15. The process of claim 14 wherein at least one of the active metal is platinum.

16. The process of claim 11 wherein the hydrofinishing conditions of step (c) comprise a pressure of between about 200 psig to about 3000 psig.

17. The process of claim 16 wherein the hydrofinishing conditions comprise a pressure of between about 500 psig and about 2000 psig.

* * * * *